US008936112B2

(12) United States Patent
Dithmar et al.

(10) Patent No.: US 8,936,112 B2
(45) Date of Patent: Jan. 20, 2015

(54) DEVICE FOR ACTUATING A BOTTOM TOOL

(75) Inventors: Erik Dithmar, Baisy-Thy (BE); Philippe R Fanuel, Brussels (BE); Stein Eric Moi, Hommersak (NO); Luis Quintana, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/594,220

(22) Filed: Aug. 24, 2012

(65) Prior Publication Data

US 2012/0318497 A1 Dec. 20, 2012

Related U.S. Application Data

(63) Continuation of application No. 11/995,495, filed as application No. PCT/BE2007/000004 on Jan. 11, 2007, now Pat. No. 8,251,161.

(51) Int. Cl.
*E21B 10/32* (2006.01)
*E21B 23/04* (2006.01)

(52) U.S. Cl.
CPC ..... *E21B 23/04* (2013.01); *E21B 10/322* (2013.01)
USPC ..... 175/276; 175/284; 175/289

(58) Field of Classification Search
CPC ..... E21B 17/06; E21B 10/322; E21B 34/14; E21B 10/32; E21B 10/345; E21B 23/00
USPC ..... 166/242.6; 175/276, 277, 285, 284, 175/289, 267–269
See application file for complete search history.

(56) References Cited

U.S. PATENT DOCUMENTS 4,260,017 A * 4/1981 Nelson et al. ..... 166/154
4,292,988 A * 10/1981 Montgomery ..... 137/68.17
(Continued)

FOREIGN PATENT DOCUMENTS

GB 2 361 727 12/2000 ..... E21B 17/06
WO WO 2004/097163 11/2004 ..... E21B 10/32
(Continued)

OTHER PUBLICATIONS

International Search Report and Written Opinion, PCT/BE2007/000004, 12 pgs, Sep. 28, 2007.
(Continued)

*Primary Examiner* — Shane Bomar
*Assistant Examiner* — Kipp Wallace
(74) *Attorney, Agent, or Firm* — Baker Botts L.L.P.

(57) ABSTRACT

A downhole tool may include a generally hollow piston having a trigger element extending therefrom, the piston configured to slide along an axial cavity extending through a tubular body of the tool. The trigger element may move from a first position where the trigger engages a support on the body and the piston is fixed, to a second position where the trigger disengages and the piston is released. The tool may also include a generally tubular relief sleeve releasably coupled with the piston using a shear pin, while the trigger element is in the first position, and disposed between the trigger and an extension of the piston, to allow the sleeve to slide between the trigger and the extension after shearing of the pin. The piston, sleeve and pin may be configured to allow the sleeve to release from the piston in response to the shearing of the pin.

28 Claims, 5 Drawing Sheets

(56) References Cited

U.S. PATENT DOCUMENTS

| | | | | |
|---|---|---|---|---|
| 4,452,472 | A | 6/1984 | Crase | 285/3 |
| 4,646,846 | A | 3/1987 | Byrne | 169/42 |
| 4,646,856 | A * | 3/1987 | Dismukes | 175/107 |
| 5,117,910 | A * | 6/1992 | Brandell et al. | 166/291 |
| 5,960,879 | A | 10/1999 | Echols | 166/278 |
| 6,079,496 | A * | 6/2000 | Hirth | 166/321 |
| 6,408,946 | B1 | 6/2002 | Marshall et al. | 166/317 |
| 6,772,835 | B2 | 8/2004 | Rogers et al. | 166/177.4 |
| 7,401,666 | B2 * | 7/2008 | Fanuel et al. | 175/285 |
| 7,426,964 | B2 | 9/2008 | Lynde et al. | 166/377 |
| 7,549,485 | B2 | 6/2009 | Radford et al. | 175/57 |
| 2003/0164251 | A1 | 9/2003 | Tulloch | |
| 2004/0065479 | A1 | 4/2004 | Fanuel et al. | |
| 2005/0241856 | A1 * | 11/2005 | Lassoie et al. | 175/57 |
| 2005/0274546 | A1 * | 12/2005 | Fanuel et al. | 175/57 |

FOREIGN PATENT DOCUMENTS

| | | | |
|---|---|---|---|
| WO | 2005/094166 | 10/2005 | |
| WO | 2005/103435 | 11/2005 | E21B 10/32 |
| WO | 2005/124094 | 12/2005 | E21B 10/32 |
| WO | WO 2008/083448 | 7/2008 | E21B 10/32 |

OTHER PUBLICATIONS

Canadian Office Action; Application No. 2,674,030; pp. 3, Dec. 16, 2013.

Canadian Office Action; Application No. 2,674,030; pp. 2, Mar. 18, 2013.

Singaporean Search and Examination Report; Application No. 200904639-2; pp. 11, Nov. 11, 2010.

* cited by examiner

DEVICE FOR ACTUATING A BOTTOM TOOL

CROSS REFERENCE TO RELATED APPLICATIONS

This application is a Continuation of U.S. patent application Ser. No. 11/995,495 filed Jan. 11, 2008 now U.S. Pat. No. 8,251,161, which is a U.S. National Stage Application of International Application Ser. No. PCT/BE2007/000004 filed Jan. 11, 2007, which designates the United States of America, and the contents of which are hereby incorporated by reference in their entirety.

TECHNICAL FIELD OF THE INVENTION

This invention relates in general to earth formation and drilling, and more particularly to a reaming and stabilization tool and method for its use in a borehole.

BACKGROUND OF THE INVENTION

Downhole tools are known, for example underreaming and stabilisation tools to be used in a bore hole (see for example PCT Application No. WO 2005/124094).

Drilling, underreaming or other tools are often lowered with the hollow piston held fixedly inside the tubular body and then, when the tool is in position, the hollow piston can be activated. A system for locking the piston has already been envisaged which, in a closed position, holds the hollow piston axially in an immobilisation position and which is brought into the release position by electrical control.

However, in general terms, it is more usual to control the activation of the hollow piston hydraulically, by means of a fluid formed by drilling mud. When the latter circulates in the string connecting the tool to the surface, the piston immobilised by the activation device is subjected to a differential pressure that acts on the piston upwards or downwards. The activation device provides a tubular extension extending the piston. The end of this extension is kept fixed in a tubular sleeve by shear pins. A sleeve bears on a ring forming a stop and fixed to the tubular body of the tool. This stop prevents the movement of the piston subjected to a differential pressure and therefore producing a traction force on the tubular sleeve, as long as this pressure remains below a predetermined threshold.

The shear pins are calibrated so that a traction force of the piston greater than the above-mentioned threshold causes a shearing of the pins and releases the hollow piston, which can then slide in the axial cavity in the tubular body of the tool. In the case of an underreaming tool, the piston, which has become driving, then allows the deployment of a cutting arm.

The calibrated value of the shear pins is a compromise between on the one hand the limit of use of the tool in its dormant mode, that is to say when the hollow piston is not activated, and the limit of the maximum pressure acceptable for the tool or available through the drilling pumps.

In order not to limit the working capacities of the tool in dormant mode and to prevent, which is not always possible, risks of accidental activation that might be caused for example by a pressure jolt, the calibre of the shear pins is designed so as to be relatively high. The shearing is caused by a temporary closure of the tubular sleeve by a ball and/or a very significant increase in the pressure of the drilling mud. The substantial energy stored by the driving piston must then be dissipated on the release of the piston caused by the rupture of the pins. The shock that results from this may cause deformation of parts and impair the subsequent functioning of the tool.

Moreover, experience has shown that dead volumes and play between parts could present an obstacle to the correct function of the mechanism of the tool. This is because the particles present in drilling mud may compact or cement at these places so as to interfere with or prevent the movement of the parts.

SUMMARY OF THE INVENTION

A goal of a particular embodiment of the present invention is to develop an activation device that limits or eliminates the risks of accidental activation of the hollow piston and that allows selective activation of the latter without significant release of energy so as to free the hollow piston in the axial cavity of the drilling tool, in a manner that is appropriate. Advantageously, safety measures may also be provided in order to avoid the movement of the parts of the tool being prevented or interfered with by the drilling mud.

In accordance with a particular embodiment of the application, a downhole tool includes a generally tubular body having a generally axial cavity extending therethrough, and a hollow piston configured to slide along the axial cavity. The downhole tool also includes an activation device for activating the hollow piston.

The activation device may include a trigger element integral with the hollow piston, that is movable from a first position in which the trigger element is held in abutment against a support on the tubular body and the piston is fixed, towards a retracted second position in which the trigger element is not in abutment against the support and the hollow piston is released. The activation device may also include a generally tubular relief sleeve for the trigger element. The sleeve may be coupled with the hollow piston using at least one shear pin when the trigger element is in the first position, to prevent movement of the trigger element from the first position to the second position. The activation device may also include a temporary closure for at least temporarily closing the tubular relief sleeve to cause a rise in hydraulic pressure on the tubular sleeve to shear the at least one shear pin, and to cause a sliding of the tubular relief sleeve into a release position allowing movement of the trigger element from the first position to the second position.

A technical advantage of particular embodiments of the present application is that, in the dormant mode of the tool, the traction forces exerted by the hollow piston under the action of a differential pressure are not directly transmitted to the shear pins of the activation device. On the contrary, in this embodiment, it is the trigger element that keeps the hollow piston immobilised, by abutment on a fixed ring, integral with the tubular body of the tool, the trigger element and the support being in no way intended to be ruptured during use. The risks of accidental activation during the working phase in dormant mode of the tool are thus minimized or eliminated.

Another technical advantage of particular embodiments of the present application is that a hydraulic pressure can be applied to the sleeve only when the latter is closed. There is therefore selective activation of the piston, since it can take place only through an intended closure of the sleeve, which is controlled from the surface. Since there is no direct link between the traction forces exerted by the piston and the shear forces of the pins, the latter can be calibrated to a much lower resistance value than before and the activation pressure necessary for rupturing them can be relatively low, which makes it possible to avoid excessive involvement of energy and therefore potential damage to the equipment.

According to another embodiment of the application, the tubular relief sleeve may be inserted between the trigger element integral with the hollow piston and an extension of the hollow piston, so as to be able to slide between them after shearing of the at least one shear pin.

According to yet another embodiment of the application, the tubular sleeve comprises a first part with a wall having a first thickness and a second part with a wall having a second thickness less than the first and, in its position of immobilisation of the hollow piston, the trigger element is in abutment radially on the first wall part of the tubular sleeve and, in its retracted position, it is in abutment radially on the second wall part.

According to still another embodiment of the application, the trigger element is formed by a ring of blades that extend axially around the first part of the tubular sleeve in the position of immobilisation of the trigger element and that come into abutment radially on the second part of the tubular sleeve when the trigger element is in the retracted position.

In this embodiment, the tubular extension extending the hollow piston is therefore provided with a ring of blades, which may be made of metal, for example spring steel. The rigid tubular sleeve may be held so as to be fixed to this extension by shear pins. In this position the blades rest on the thick part of the sleeve and are therefore kept distant from one another. The ends of these blades, which may be thick and project radially towards the outside, are therefore in axial abutment against a retaining ring projecting radially inside the tubular body. This arrangement limits or prevents any movement of the piston and the tool is kept in its dormant mode.

According to yet another embodiment of the invention the temporary closure means is a ball launched in the axial cavity, the tubular relief sleeve comprising a seat for receiving this ball and lateral openings for re-establishing a circulation of hydraulic fluid when the tubular sleeve is in its release position. In this embodiment, a hydraulic pressure obtained by closure of the drilling mud passage by means of the ball exerts a force on the sleeve. This force, which may be minimal, causes the shearing of the shear pins and releases the sleeve, which is able to move away. The blades of the trigger element are then opposite the thin part of the sleeve and can flex radially inwards, for example under a radial thrust of the retaining ring or under the action of an elastic return force. In this flexed position, the blades can slide inside the retaining ring under the action of the traction of the released hollow piston. The tool is then activated.

According to still another embodiment of the application, the tool may also include a chamber in a dead end that extends annularly between the tubular body and the hollow piston and/or a tubular extension thereof where drilling mud passes, a surface of the hollow piston axially delimiting this dead-end chamber, on a first side. The tool may also include an annular ring that axially delimits the dead-end chamber, on a second side opposite to the above-mentioned first side, and which is connected to the tubular body by at least one shear pin.

This embodiment may allow for communication for a fluid between the inside of the hollow piston and/or its tubular extension and the dead-end chamber, the surface of the hollow piston being thus subjected to the variable differential hydraulic pressures of the drilling mud. In this embodiment, the hollow piston, released by retraction of the trigger element, may be capable of sliding between the first position in which the dead-end chamber has a first volume and a second position in which the dead-end chamber has a second volume greater than the first. The tool may also include return means that act on the hollow piston in order to return it to its first position. In this embodiment, the at least one shear pin, when an obstacle prevents the hollow piston returning to its first position and thus increases the pressure applied to the annular ring beyond a predetermined threshold, may be sheared, releasing the annular ring and thus allowing the hollow piston to return to its first position.

Other details of the invention will emerge from the description given below, non-limitingly, of an embodiment of the downhole tool provided with an activation device according to the invention.

BRIEF DESCRIPTION OF THE DRAWINGS

In the various drawings the identical or similar elements bear the same references.

DETAILED DESCRIPTION OF EXAMPLE EMBODIMENTS

Figure 1:
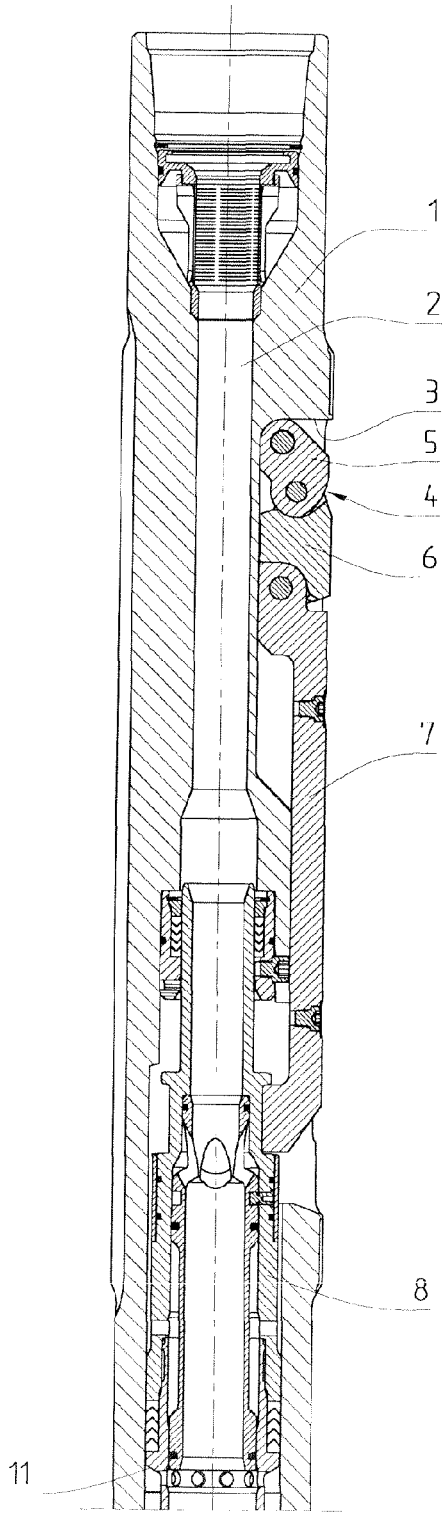
FIGS. 1 and 2 depict a view in axial section of the same underreaming tool provided with an activation device according to the invention.
Figure 2:
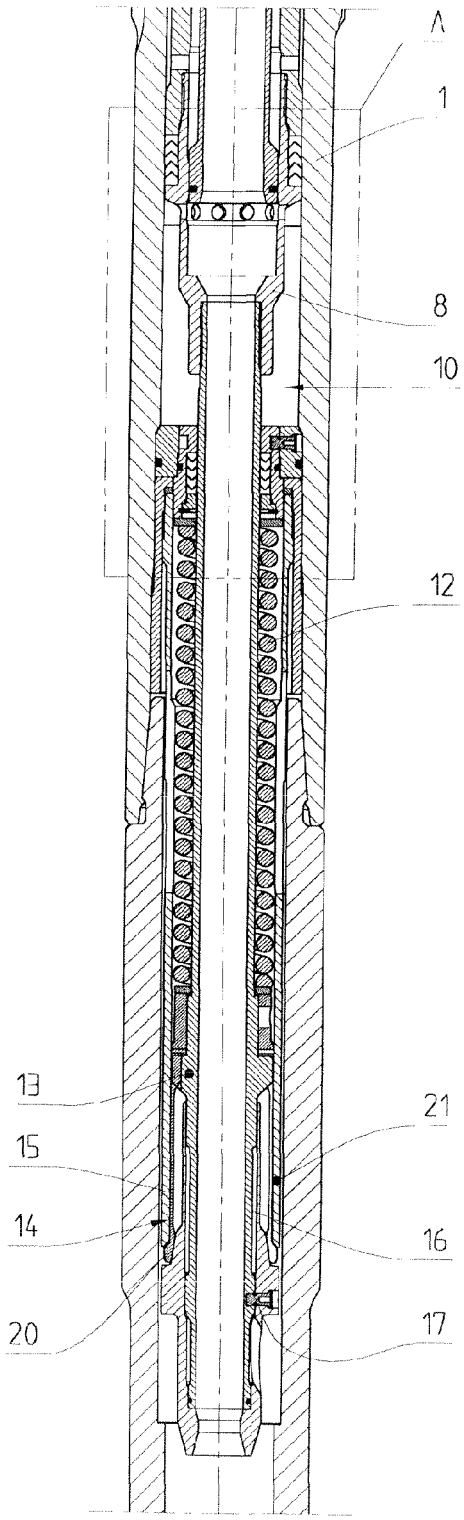

The description of FIGS. 1 and 2 relates to an example of a downhole tool according to the invention on which an activation device can be arranged. Provision has been made here, by way of example, for the tool to be an underreaming and/or stabilisation tool to be used in a borehole. It could, however, be any tool using a driving piston that is to be activated only when the tool is in position in the borehole and which is otherwise immobilized during descent.

The tool illustrated in FIGS. 1 and 2 comprises a tubular body 1 to be mounted between a first section of a string and a second section thereof. This tubular body 1 has an axial cavity 2 in which the drilling mud circulates. At the periphery the tubular body 1 comprises housings 3 with an opening to the outside.

In the example illustrated, a knife element 4 is housed in each housing 3 and comprises two cutting arms 5 and 6 articulated on each other and on a transmission means in the form of a slide 7. In the position illustrated, the arms 5 and 6 are retracted into their housing and the tool is in dormant mode.

In the example illustrated, a drive means designed in the form of a hollow piston 8 is arranged inside the tubular body 1, allowing circulation of the mud without hindrance inside the tubular body. The hollow piston 8 is coupled with the slide 7.

Figure 6:
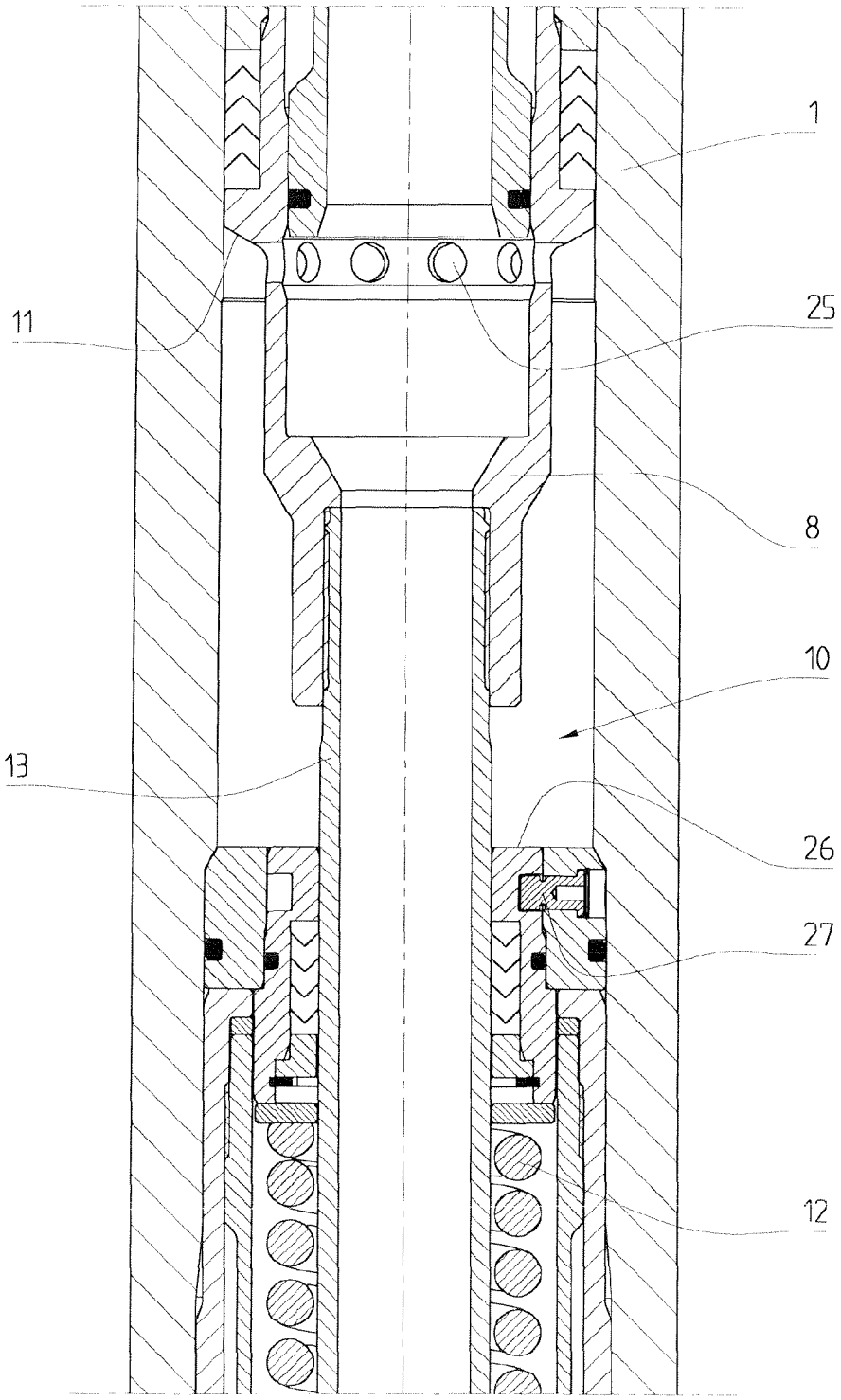
FIG. 6 depicts a view to an enlarged scale of the detail A in FIG. 2.

As is clear from FIGS. 1, 2 and 6, the drilling mud can accumulate in an annular chamber or dead-end 10 where the piston 8 is, through its surface 11, in contact with the hydraulic fluid under pressure formed by the drilling mud. The piston is, in the case illustrated, indirectly in abutment on a return spring 12 which, at its opposite end, abuts on an element integral with the tubular body 1 and acts in the opposite direction to the aforementioned pressure of the hydraulic fluid passing through the axial cavity 2.

Figure 3:
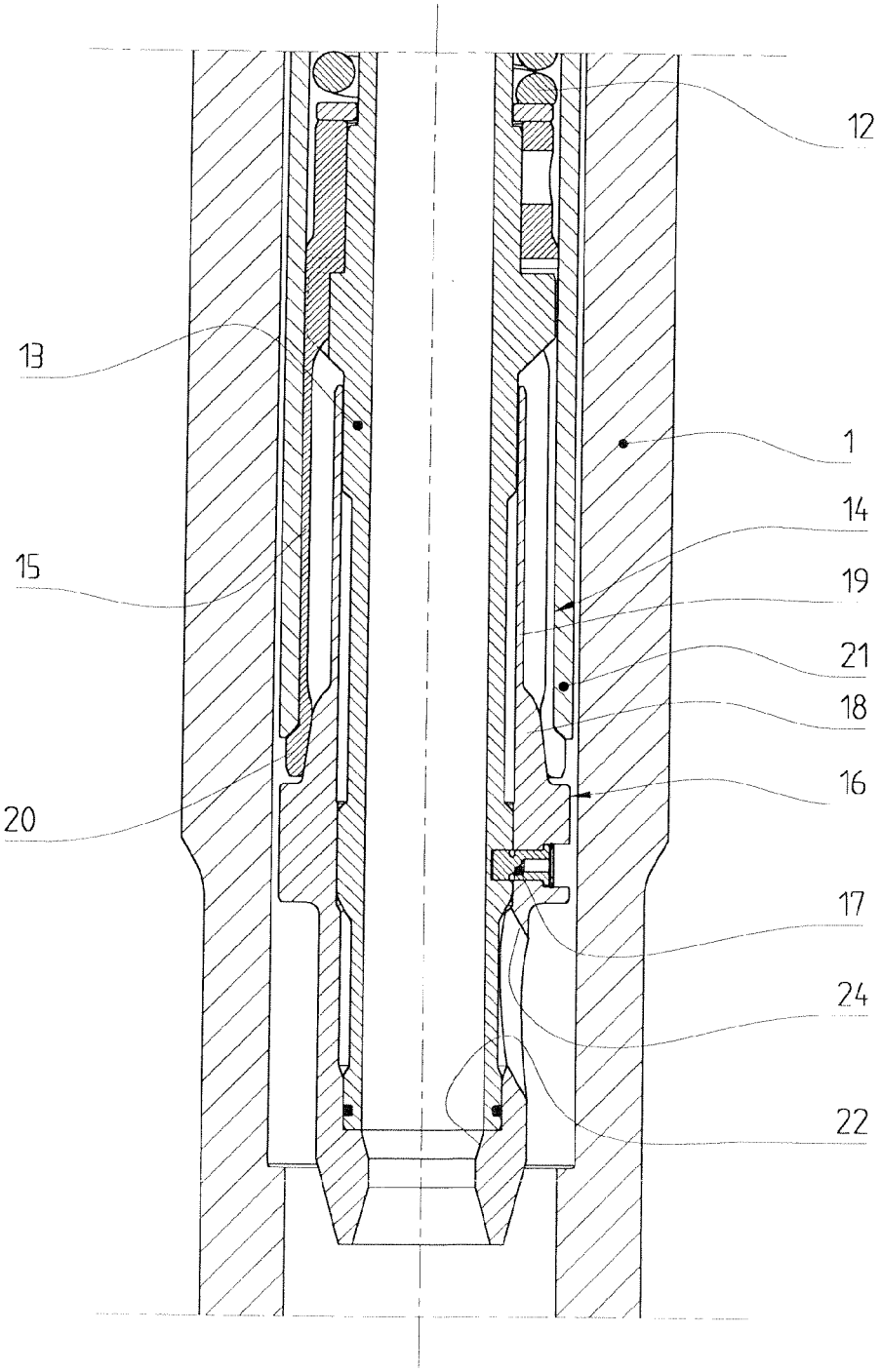
FIG. 3 depicts a view in axial section of an activation device according to the invention, in which the tool is functioning in dormant mode.
Figure 4:
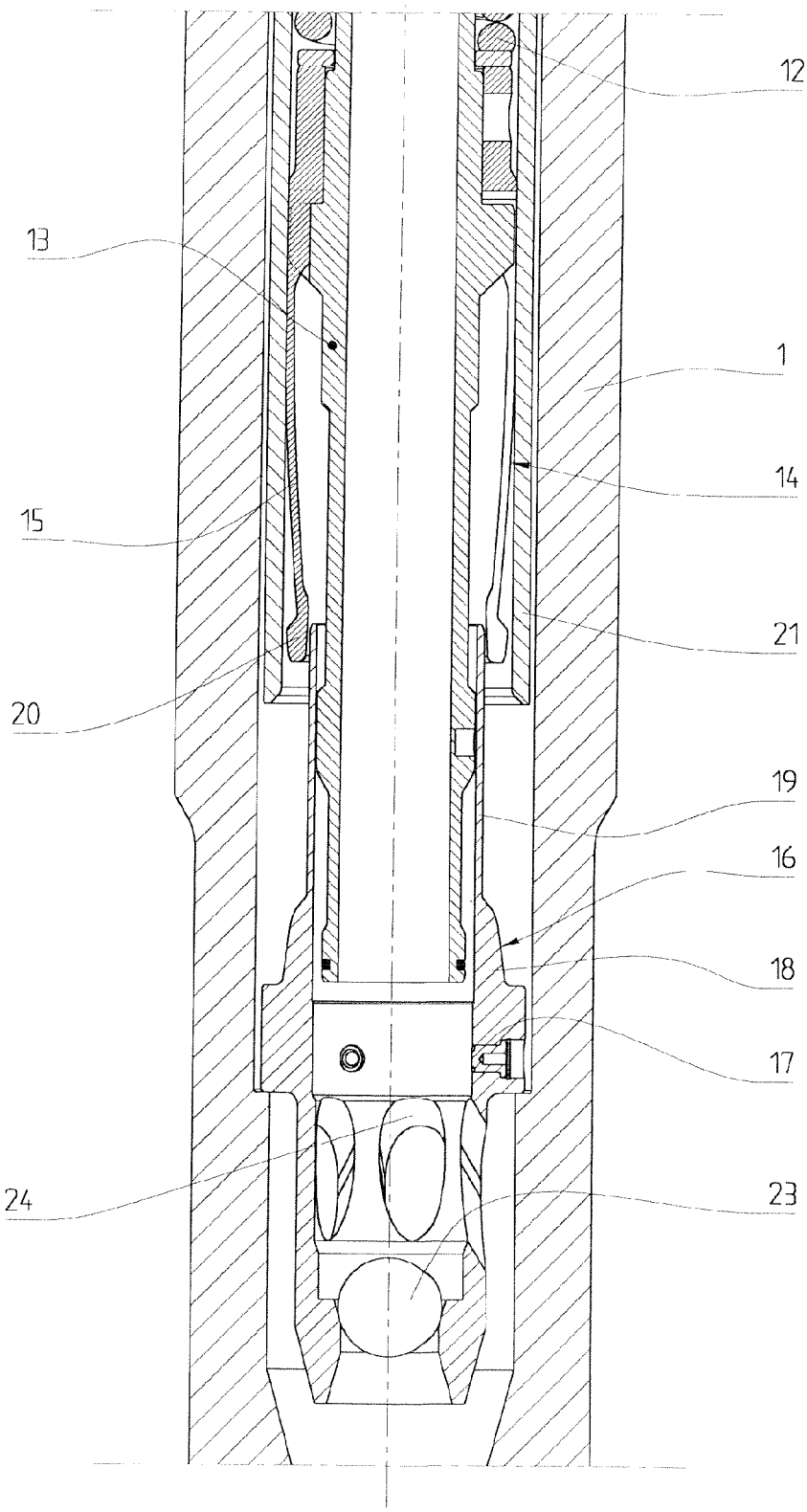
FIG. 4 depicts a view in axial section of the activation device according to FIG. 3, in which the tool is in activated mode.
Figure 5:
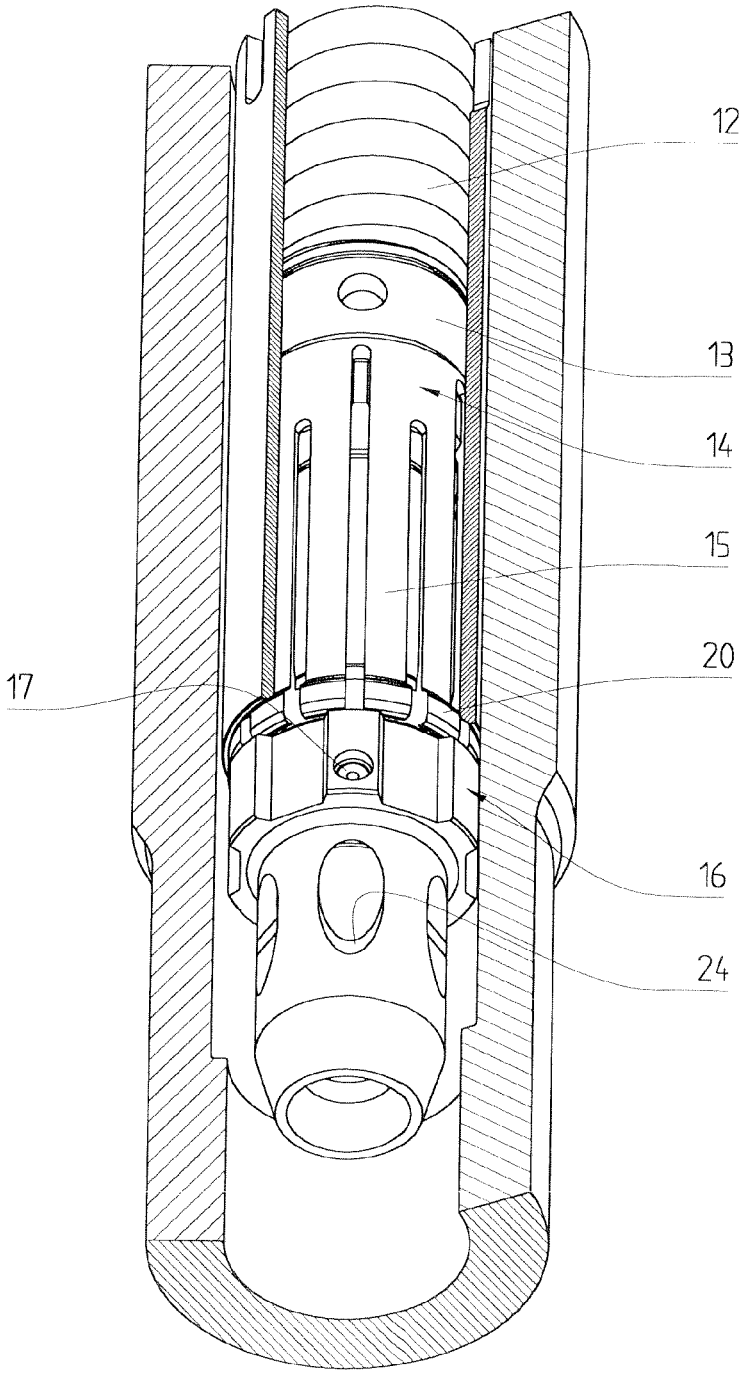
FIG. 5 depicts a partially broken perspective view of the activation device illustrated in FIGS. 3 and 4.

As depicted in more detail in the example embodiment illustrated in FIGS. 3 to 5, the piston 8 is provided with a tubular extension 13 on the downstream side around which the return spring is arranged, whilst bearing on it, which allows an off-centre arrangement of the spring 12 with respect to the cutting arms. This extension is provided with a trigger element 14 that is therefore integral with the piston 8. In the example illustrated, the trigger element is formed by a ring of blades 15, that may be flexible, for example made from spring steel, which extend axially in the downstream direction, around a part of the tubular extension 13.

A tubular relief sleeve 16 may be inserted between the blades 15 of the trigger element 14 and the tubular extension 13 of the hollow piston 8. This sleeve may be connected to the extension 13 by shear pins 17, only one of which is shown.

In the example illustrated, in its downstream part 18, the tubular sleeve 16 has a greater thickness than in its upstream part 19 and the transition between the downstream and upstream parts may be effected on a slope. In the position illustrated in FIG. 3, when the tubular sleeve 16 is immobilised on the tubular extension 13, the blades 15 of the trigger element 14 are in abutment on the thicker downstream part 18 of the sleeve and are therefore kept separated radially outwards.

In this separation position, the free end 20, which may be thickened, of the blades 15 comes axially into abutment against a retaining ring 21, integral with the tubular body 1 of the tool.

When the tool has descended in dormant mode, even if the hydraulic pressure of the mud exerted on the piston 8 is high and develops an upward traction force, this is counteracted by the abutment of the blades 15 against the retaining ring 21.

At its downstream end the tubular relief sleeve 16 is provided with a reception seat 22 intended to receive a closure means 23, for example a ball in the case illustrated, which may be launched from the surface. The sleeve 16 may also be provided with lateral openings 24, only one of which is depicted in FIG. 3. When a ball is caused to close off the passage of the mud in the axial cavity, the abrupt increase in pressure exerted on the tubular sleeve 16 has the effect of shearing the pins 17, releasing the sleeve. The latter can then slide downstream between the blades 15 of the trigger element and the tubular extension 13 of the hollow piston. In this position illustrated in FIG. 4, the lateral openings 24 make it possible to re-establish the circulation of mud in the axial cavity.

As is clear from FIG. 4, the blades 15 have, by elastic return, arrived in radial abutment against the thin part 19 of the tubular relief sleeve 16. It would also be possible to make provision for this flexing of the blades 15 to result in an elastic deformation under a thrust in the radial direction of the slanting end of the retaining ring 21. The blades 15 have thus passed into a retracted position in which they are no longer in axial abutment against the retaining ring 21. Under the action of the hollow piston 8 subjected to a hydraulic pressure that pushes it upstream, the blades 15 of the trigger element 14 in the retracted position can pass inside the ring 21. The hollow piston 8 is now released and the tool is activated. In the present embodiment the piston can control a deployment of the cutting arms 5 and 6 in order to proceed for example with an underreaming of the borehole.

As is clear from FIG. 6, and as already indicated previously, in the illustrated embodiment the tool has an annular dead-end chamber 10 that extends between on the one hand the tubular body 1 and on the other hand the hollow piston 8 and its tubular extension 13 through which the drilling mud passes. The surface 11 of the piston axially delimits the chamber 10 on one side and on the opposite side it is delimited by an annular ring 26. This annular ring 26 is connected to the tubular body 1 by means of at least one shear pin 27.

A communication for fluid, in the form of orifices 25, enables the drilling mud inside the hollow piston 8 to enter the annular chamber 10. The surface 11 of the piston 8 is thus subjected to the variations in pressure of the drilling mud passing through the tool. The hollow piston 8, released by retraction of the trigger element, is thus capable of sliding between a first position depicted in FIG. 6, which corresponds to the immobilisation position of the non-released piston, and a position where the annular chamber 10 has a volume greater than that of the first position, the piston being pushed upwards under the pressure of the drilling mud. The piston can be returned towards its first position by the return spring 12 in the case of a reduction in the pressure of the drilling mud that has passed through the body of the tool.

Each movement of the drive piston 8 causes suction (an increase in the volume of the chamber 10 when the piston is in the high position) and rejection (a reduction in the volume 10 when the piston is in the lowered position) of the drilling mud through the orifices 25 into and respectively out of the dead-end chamber 10. These movements of mud, associated with the effects of settling of solid particles from the mud and/or centrifugal effects of the solid particles in the mud, may cause excessive fouling of the volume of the chamber 10. In addition, the percentage of the volume of stagnant mud, which is not renewed, may present a cementation phenomenon. The packing of the volume of the chamber 10 may thus prevent complete travel of the movement of the drive piston, by impeding the complete withdrawal of the cutting arms 5 and 6.

In this configuration, the cutting arms partially exposed outside the principal tubular body 1 form an obstacle to the rising of the tool, when passing a restriction in the diameter of the well. The reaction on the cutting arms due to the traction force of the tool blocked by the restriction in the diameter of the hole, transmits, by means of the slides 7, an additional return force to the drive piston. The increase in the effect of compacting of the particles in the dead space of the chamber 10 generates a pressure on the ring 26. This pressure force on the ring 26 causes, beyond a predetermined threshold, a shearing of the pins 27 of this ring 26. The ring, no longer being integral with the principal tubular body 1, may, under the effect of the pressure of the compacting, move downwards, then allowing complete movement of the drive piston and consequently the complete withdrawal of the cutting arms.

In accordance with another example embodiment, provision can be made for filling in the clearances between parts and the dead volumes of the mechanism with a given grease or gel. This prevents the drilling mud from coming to occupy these spaces and interfering with the functioning of the tool. It may be advantageous consequently to fill the annular dead-end chamber 10 with such a material, this chamber being able to be considered as a dead space.

Moreover, it can be seen that the longitudinal movements of the mechanism cause variations in volume at various places on the tool, as is the case for example in the annular chamber 10. These variations in volume cause effects of suction and discharge of the drilling mud with the aforementioned known drawbacks.

It may therefore be advantageous to size the part so as to obtain a dead space as large as possible in comparison with the variation in volume caused by the mechanical movements, in order to limit the effects of compacting of the mud.

It must be understood that the present invention is in no way limited to the embodiment described above and that many modifications can be made thereto without departing from the scope of the accompanying claims.

It is for example possible to provide for the piston and its tubular extension to be arranged so as to undergo, on the part of the drilling mud, a pressure directed downwards.

The invention claimed is:

1. A downhole tool, comprising:

a generally tubular body having an axial cavity extending therethrough;

a hollow piston configured to slide along the axial cavity;

an activation device for activating the hollow piston, the activation device comprising:

a trigger element integral with the hollow piston, the trigger element being movable from a first position, in which the hollow piston is fixed by the trigger element, towards a retracted second position in which the hollow piston is released, the trigger element formed by a ring of blades that extend axially in a downhole direction around an extension of the hollow piston;

a generally tubular relief sleeve for the trigger element, the tubular relief sleeve being coupled with the hollow piston using at least one shear pin when the trigger element is in the first position to prevent movement of the trigger element from the first position to the second position; and a temporary closure component being launchable in the axial cavity and receivable by a seat of the tubular relief sleeve, the temporary closure component configured to:

at least temporary close the tubular relief sleeve to cause a rise in hydraulic pressure on the tubular sleeve to shear the at least one shear pin; and cause a sliding of the tubular relief sleeve into a release position allowing movement of the trigger element from the first position to the second position.

2. The downhole tool of claim 1, wherein the tubular relief sleeve is disposed between the trigger element and the extension of the hollow piston; and configured to allow the tubular relief sleeve to slide between the trigger element and the extension after shearing of the at least one shear pin.

3. The downhole tool of claim 2, wherein the tubular relief sleeve comprises a first portion with a wall having a first thickness, and a second portion with a wall having a second thickness less than the first thickness, wherein the trigger element is in abutment radially on the first portion when the trigger element is in the first position and, wherein the trigger element is in abutment radially on the second portion when the trigger element is in the second position.

4. The downhole tool of claim 3, wherein:

the generally tubular body comprises a retaining ring projecting radially towards an interior of the axial cavity, and the trigger element is in abutment axially against the retaining ring when the trigger element is in the first position and, configured to be driven by the hollow piston released inside the retaining ring when the trigger element is in the second position.

5. The downhole tool of claim 3, wherein:

the tubular relief sleeve is disposed between the trigger element and the extension of the hollow piston; and the blades of the trigger element extend axially around the first portion of the tubular relief sleeve when the trigger element is in the first position, and radially abut the second portion of the relief sleeve when the trigger element is in the second position.

6. The downhole tool of claim 1, wherein the ring of blades comprise a flexible, corrosion resistant matermaterial.

7. The downhole tool of claim 1, wherein the ring of blades include a thickened free end that projects radially towards an exterior and which, in the first position of trigger element, are in axial abutment against the retaining ring.

8. The downhole tool of claim 1, wherein the tubular relief sleeve comprises lateral openings configured to re-establish a circulation of hydraulic fluid when the tubular sleeve is in the release position.

9. The downhole tool of claim 1, wherein the downhole tool comprises an underreamer provided with knife elements formed by articulated cutting arms and wherein the hollow piston is configured to allow extension of the cutting arms out of the tubular body of the tool.

10. The downhole tool of claim 9, further comprising a return spring coupled with the hollow piston, the return spring biasing the hollow piston toward the first position, in which the cutting arms are in the retracted position.

11. The downhole tool of claim 10, wherein the return spring is arranged around a tubular extension of the hollow piston and the return spring bears on the hollow piston.

12. The downhole tool of claim 1, further comprising:

a dead end chamber that extends annularly between the tubular body and the hollow piston, a surface of the hollow piston axially delimiting the dead-end chamber on a first side;

an annular ring that axially delimits the dead-end chamber on a second side, opposite to the first side, and which is coupled with the tubular body by at least a second shear pin;

a communication path for a fluid between an inside of the hollow piston and the dead-end chamber, to allow the surface of the hollow piston to be subjected to variable differential hydraulic pressures of drilling mud;

the hollow piston being configured to slide between a first position in which the dead-end chamber has a first volume and a second position in which the dead-end chamber has a second volume greater than the first; and return means that act on the hollow piston in order to return it to its first position.

13. The downhole tool of claim 12, wherein the second shear pin is configured to shear when an obstacle prevents the hollow piston returning to its first position and thus increases the pressure applied to the annular ring beyond a predetermined threshold.

14. The downhole tool of claim 1, wherein:

the trigger element s held in abutment against a support on the tubular body in the first position; and the trigger element is not in abutment against the support in the second position.

15. The downhole tool of claim 1, wherein the temporary closure component is a ball.

16. A downhole tool, comprising:

a generally hollow piston having a trigger element extending therefrom, the hollow piston being configured to slide along an axial cavity extending through a tubular body of the downhole tool;

the trigger element being moveable from a first position, in which the piston is fixed by the trigger element, a second position in which the piston is released, the trigger element formed by a ring of blades that extend axially in a downhole direction around an extension of the hollow piston;

a generally tubular relief sleeve being releasably coupled with the hollow piston using a shear pin, while the trigger element is in the first position;

a return spring coupled with the hollow piston, the return spring configured to bias the hollow piston toward the first position; and the hollow piston, relief sleeve and shear pin being configured to allow the relief sleeve to release from the hollow piston in response to the shearing of the shear pin.

17. The downhole tool of claim 16, wherein the tubular relief sleeve is disposed between the trigger element and the extension of the hollow piston, to allow the tubular relief sleeve to slide between the trigger element and the extension after shearing of the shear pin.

18. The downhole tool of claim 17, wherein the tubular relief sleeve comprises a first portion with a wall having a first thickness, and a second portion with a wall having a second thickness less than the first thickness, wherein the trigger element is in abutment radially on the first portion when the trigger element is in the first position and, wherein the trigger element is in abutment radially on the second portion when the trigger element is in the second position.

19. The downhole tool of claim 18, wherein:

the generally tubular body comprises a retaining ring projecting radially towards an interior of the axial cavity, and the trigger element is in abutment axially against the retaining ring when the trigger element is in the first position and, configured to be driven by the hollow piston released inside the retaining ring when the trigger element is in the second position.

20. The downhole tool of claim 18, wherein:

the tubular relief sleeve is disposed between the trigger element and the extension of the hollow piston; and the blades of the trigger element extend axially around the first portion of the tubular relief sleeve when the trigger element is in the first position, and radially abut the second portion of the tubular relief sleeve when the trigger element is in the second position.

21. The downhole tool of claim 16, wherein the ring of blades include a thickened free end that projects radially towards an exterior and which, in the first position of trigger element, are in axial abutment against the retaining ring.

22. The downhole tool of claim 16, wherein the tubular relief sleeve comprises a seat for receiving a temporary closure component, and lateral openings configured to re-establishing a circulation of hydraulic fluid when the tubular sleeve is in the release position.

23. The downhole tool of claim 16, wherein the downhole tool comprises an underreamer provided with knife elements formed by articulated cutting arms and wherein the hollow piston comprises a drive means allowing extension of the cutting arms out of the tubular body of the tool.

24. The downhole tool of claim 23, wherein the cutting arms are in the retracted position when the hollow piston is in the first position.

25. The downhole tool of claim 16, wherein clearances between parts and dead spaces are filled with a grease or gel.

26. The downhole tool of claim 16, wherein:

the trigger element is held in abutment against a support on the tubular body in the first position; and the trigger element is not in abutment against the support in the second position.

27. The downhole tool of claim 22, wherein the temporary closure component, when received by the seat of the tubular relief sleeve, is configured to:

at least temporarily close the tubular relief sleeve to cause a rise in hydraulic pressure on the tubular sleeve to shear the at least one shear pin; and cause a sliding of the tubular relief sleeve into a release position allowing movement of the trigger element from the first position to the second position.

28. The downhole tool of claim 22, wherein the temporary closure component is a ball being launchable into the axial cavity.

* * * * *